US007454161B2

(12) United States Patent
Watanabe et al.

(10) Patent No.: US 7,454,161 B2
(45) Date of Patent: Nov. 18, 2008

(54) FIXING DEVICE AND IMAGE FORMING APPARATUS HAVING THE SAME

(75) Inventors: Osamu Watanabe, Yokohama (JP); Takashi Ando, Yokohama (JP)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 303 days.

(21) Appl. No.: 11/234,270

(22) Filed: Sep. 26, 2005

(65) Prior Publication Data

US 2006/0093416 A1 May 4, 2006

(30) Foreign Application Priority Data

| | | |
|---|---|---|
| Nov. 2, 2002 | (JP) | 2004-319703 |
| Nov. 2, 2004 | (JP) | 2004-319697 |
| Nov. 2, 2004 | (JP) | 2004-319698 |
| Nov. 2, 2004 | (JP) | 2004-319701 |
| Jul. 22, 2005 | (KR) | 10-2005-0066967 |

(51) Int. Cl.
*G03G 15/20* (2006.01)

(52) U.S. Cl. ..... 399/329

(58) Field of Classification Search ..... 399/329; 219/469–471, 216

See application file for complete search history.

(56) References Cited

U.S. PATENT DOCUMENTS

| | | | | |
|---|---|---|---|---|
| 3,637,976 | A * | 1/1972 | Ohta et al. | 219/216 |
| 5,528,351 | A * | 6/1996 | Tsuji | 219/216 |
| 7,136,615 | B2 * | 11/2006 | Oohara et al. | 399/329 |
| 2003/0183610 | A1 * | 10/2003 | Okabayashi et al. | 219/216 |
| 2003/0185605 | A1 * | 10/2003 | Okabayashi | 399/329 |
| 2006/0093411 | A1 * | 5/2006 | Watanabe et al. | 399/329 |
| 2006/0093417 | A1 * | 5/2006 | Watanabe et al. | 399/329 |
| 2006/0093418 | A1 * | 5/2006 | Watanabe et al. | 399/329 |

FOREIGN PATENT DOCUMENTS

| | | |
|---|---|---|
| JP | 61-018982 | 1/1986 |
| JP | 63-066046 | 3/1988 |
| JP | 04-020441 | 1/1992 |
| JP | 06-043773 | 2/1994 |
| JP | 2002-207389 | 7/2002 |
| JP | 2002-251095 | 9/2002 |
| JP | 2004-184736 | 7/2004 |

* cited by examiner

*Primary Examiner*—Susan S Lee
(74) *Attorney, Agent, or Firm*—Roylance, Abrams, Berdo & Goodman, L.L.P.

(57) ABSTRACT

A fixing device and an image forming apparatus having the fixing device are provided. The fixing device includes at least two support members, a belt wound on the support members and supported to be movable in a circumferential direction of the support members, a heating member compressed to the belt, and a heat source heating the heating member. A recording medium electrostatically carrying a toner image passes through a fixing nip section formed between the belt and the heating member, thereby heating and fixing the toner image onto the recording medium. Among suspended portions of the belt suspended between the support members, a first suspended portion is in a tensile state, and the second suspended portion is in a non-tensile state. The heating member contacts the outside of the tensile suspended portion to form the fixing nip section.

40 Claims, 4 Drawing Sheets

FIXING DEVICE AND IMAGE FORMING APPARATUS HAVING THE SAME

CROSS-REFERENCE TO RELATED PATENT APPLICATIONS

This application claims the benefit under 35 U.S.C. § 119 (a) of Japanese Patent Application Nos. 2004-319697, filed on Nov. 2, 2004; No. 2004-319698, filed on Nov. 2, 2004; No. 2004-319701, filed on Nov. 2, 2004; and No. 2004-319703, filed on Nov. 2, 2004 in the Japanese Intellectual Property Office and of Korean Patent Application No. 10-2005-0066967, filed on Jul. 22, 2005, in the Korean Intellectual Property Office, the entire disclosures of each of which are hereby incorporated by reference.

BACKGROUND OF THE INVENTION

1. Field of the Invention

The present invention relates to a fixing device built in an electrophotographic image forming apparatus, such as a laser printer, a laser facsimile, and a digital copier, and an image forming apparatus having the fixing device.

2. Description of the Related Art

Generally, in electrophotographic image forming apparatuses, a photosensitive drum is almost uniformly charged. The photosensitive drum is exposed to a laser scanning unit (LSU) or the like to form an electrostatic latent image thereon corresponding to a desired image signal. Toner charged by a developing device is supplied to the photosensitive drum to form a toner image. The toner image is transferred to a recording medium. The toner image transferred to the recording medium is carried on the recording medium, but not fixed to the recording medium. Accordingly, by heating and pressing the toner image with a fixing device built in the image forming apparatus, the toner image is thermally fused and fixed to form a fixed image on the recording medium.

A conventional fixing device basically includes a cylinder-shaped heating roller (that is, a heating member) made of metal, a pressing roller (that is, a pressing member) compressed onto the heating roller, and a halogen lamp (that is, a heat source) that is inserted into the heating roller to heat the heating roller with radiant heat. In such a roller type fixing device, a recording medium carrying the toner image is conveyed to a nip section in which the heating roller and the pressing roller are mutually compressed, thereby heating the toner image on the recording medium by means of the heat of the heating roller and pressing by means of the compression of the heating roller and the pressing roller to fix the toner image onto the recording medium.

The conventional fixing device requires much time to heat a room temperature heating roller to a fixing temperature of 160 to 200° C. at which the toner is fused. Accordingly, the conventional fixing device requires considerable warm-up time to practically start a print job after it is powered on. Additionally, the fixing device should be always kept at a high temperature to shorten the time from standby status to the start of a print job. As a result, since the halogen lamp should be always turned on to keep the fixing device at a high temperature, the power consumption is increased.

Various fixing devices capable of shortening the warm-up time and reducing the power consumption have been suggested to solve the problems associated with conventional fixing devices.

For example, an induction heating type fixing device induces current with a magnetic flux to generate heat. The induction heating type fixing device basically includes a cylinder-shaped or semi-circular sectional holder, a film that is extrapolated onto the holder and that has a conductive layer and a resistor layer stacked on each other. A magnetic field generating unit has an exciting coil and a magnetic core provided inside the holder. A pressing roller is compressed onto the outer circumferential surface of the film to form a fixing nip section. In the induction heating type fixing device, eddy current is generated by means of the magnetic flux generated by the magnetic field generating unit, Joule heat is generated in the conductive layer by means of the eddy current, and the temperature of the fixing nip section is increased by means of the Joule heat. Thus, the temperature of the nip section is increased to the fixing temperature in a short period of time, thereby shortening the warm-up time. Additionally, since the film has a thermal capacity lower than that of the heating roller, the power consumption is reduced. Japanese Unexamined Patent Application Publication No. 2004-126274 discloses a conventional induction heating type fixing device. However, since the magnetic field generating unit should be provided, there is a problem that the component cost is greater than that of the roller-type fixing device. Additionally, since the inner circumferential surface of the film slides with respect to the holder or the like, the life-time of the film is limited by means of wear of the sliding portions and the range for selection of materials is narrowed.

Furthermore, a pressing belt type fixing device has a pressing roller of the roller-type fixing device replaced with a pressing belt of a tube shape and a part of the pressing belt is compressed to the heating roller from the inside thereof to form a fixing nip section. The pressing belt type fixing device basically includes a heating roller that is heated by a heat source, such as a halogen lamp, and that pivotally rotates. A pressing belt abuts the heating roller and rotates along with the heating roller. A pressing member presses the pressing belt from the inside thereof to the heating roller. In the pressing belt type fixing device having the above-mentioned structure, the pressing belt is compressed to the heating roller to form the fixing nip section, whereby the nip section is wide. Accordingly, it is possible to shorten the warm-up time and also to reduce the power consumption. Additionally, the component cost is reduced lower than that of the induction type fixing device. Japanese Unexamined Patent Application Publication No. 2004-12682 discloses a pressing belt type fixing device. However, since the inner circumferential surface of the pressing belt is pressed by the surface of the pressing member and slides, the life-time of the pressing belt or the pressing member is limited by means of wear of the sliding portion and the range for selection of materials is narrowed.

Furthermore, a heating belt type fixing device has a heating roller of the roller-type fixing device replaced with a heating belt unit having a heating belt circumferentially movable and the heating belt and the pressing roller are compressed to each other to form a fixing nip section. The heating belt type fixing device basically includes a heating belt unit in which a heating belt is wound around a support roller and a cylinder-shaped heating roller. A cylinder-shape pressing roller is compressed onto a fitting portion of the heating belt between the support roller and the heating roller. A halogen lamp is built in the heating roller or the pressing roller. In the heating belt type fixing device having the above-mentioned structure, since the fixing nip section is wide, the warm-up time is shortened and the power consumption is reduced. Additionally, since no sliding portion exists, no member is worn away and the range for selection of materials is widened. It is also possible to reduce the component cost lower than that of the fixing device of an induction heating type. Japanese Unexamined Patent Application Publication No. 2004-205877 discloses a heating belt type fixing device.

However, in the conventional heating belt type fixing device, the heating belt is made to extend by the support roller and the heating roller and tension is applied to the heating belt. As a result, by circulating the heating belt, the heating belt is moved in the axial direction of the support roller or the heating roller and is deviated toward one side due to error in measurement accuracy or assembly accuracy of the respective rollers or widthwise deviation in circumferential length of the heating belt.

Additionally, in the conventional heating belt type fixing device, the temperature of the heated fixing nip section becomes uniform as a whole. As a result, when the toner image carried on the recording medium passes through the entrance of the fixing nip portion, the toner image may not be sufficiently heated. Therefore, the interface between the toner and the recording medium may not be sufficiently fused, whereby there may be a phenomenon (cold off-set) in which a part of the toner image is attached to the heating belt by means of an adhesive force or an electrostatic force between the toner and the heating belt. Furthermore, when the toner image carried on the recording medium passes through the exit of the fixing nip portion, the toner image may be heated too much. As a result, a cohesive force of the toner is smaller than the adhesive force between the belt and the recording medium, the toner image may be separated and there may occur a phenomenon (hot off-set) in which a part of the separated toner image is attached to the belt.

Accordingly, a need exists for an improved fixing device for an image forming apparatus in which the warm-up time is shortened, power consumption is reduced and deviation of a belt is reduced.

SUMMARY OF THE INVENTION

The present invention provides a fixing device that shortens warm-up time, reduces power consumption, and reduces deviation of a belt and an image forming apparatus having the fixing device.

The present invention also provides a fixing device that prevents cold off-set or hot off-set and an image forming apparatus having the fixing device.

According to an aspect of the present invention, a fixing device includes at least two support members, a belt wound on the support members and supported to be movable in a circumferential direction of the support members, a heating member compressed to the belt, and a heat source for heating the heating member. A recording medium carrying a toner image passes through a fixing nip section formed between the belt and the heating member, thereby heating and fixing the toner image onto the recording medium. Among suspended portions of the belt suspended between the support members, one suspended portion is in a tensile state, another suspended portion is in a non-tensile state, and the heating member contacts the outside of the tensile suspended portion to form the fixing nip section.

The side surface of each support member may be provided with a pinch member compressed to the support member, and the belt may be sandwiched between the support member and the pinch member.

Additionally, the support members and the heating member may be compressed to each other upstream and downstream in a direction in which the recording medium is conveyed, respectively.

Furthermore, the support members and the heating member may be compressed to each other upstream or downstream in the direction in which the recording medium is conveyed.

According to another aspect of the present invention, a fixing device includes at least two support members, a belt wound on the support members and supported to be movable in a circumferential direction of the support members, a heat source for heating the belt, and a pressing member compressed to the belt. A recording medium carrying a toner image passes through a fixing nip section formed between the belt and the pressing member, thereby heating and fixing the toner image onto the recording medium. Among suspended portions of the belt suspended between the support members, one suspended portion is in a tensile state, another suspended portion is-in a non-tensile state, and the pressing member contacts the outside of the tensile suspended portion to form the fixing nip section.

A temperature gradient that lowers from upstream to downstream in a direction in which the recording medium is conveyed may be given to the fixing nip section by means of the heat source.

A directional cover that concentrates radiant heat of the heat source on the entrance of the fixing nip section may be provided on the outer circumference of the heat source. The cover provided on the outer circumference of the heat source may be opened to the entrance of the fixing nip section.

The support members and the pressing member may be compressed to each other upstream and downstream in a direction in which the recording medium is conveyed, respectively. Both ends of one suspended portion among the suspended portions of the belt suspended between the support members may be sandwiched between the support members and the pressing member in a tensile state.

According to another aspect of the present invention, an image forming apparatus includes an image forming means for electrostatically transferring a toner image to a recording medium, and the image forming apparatus includes the above-mentioned fixing device.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Hereinafter, structures and operations of fixing devices and image forming apparatuses the fixing devices according to first to fifth exemplary embodiments of the present invention will be described in detail with respect to the accompanying drawings.

FIRST EXEMPLARY EMBODIMENT

Figure 1:
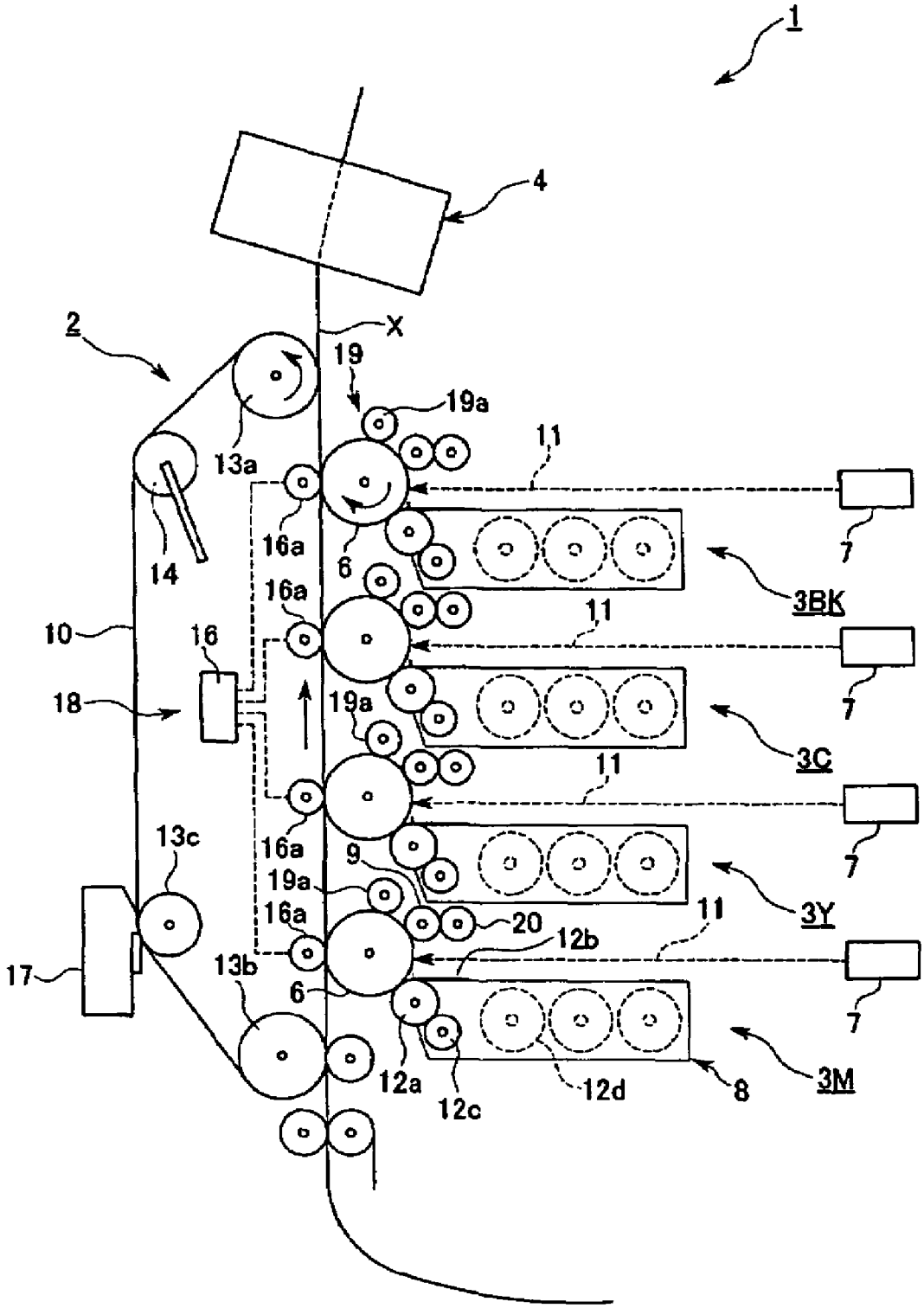
FIG. 1 is a schematic diagram of an image forming apparatus according to exemplary embodiments of a fixing device and an image forming apparatus of the present invention.

FIG. 1 is a schematic diagram of an image forming apparatus 1 according to exemplary embodiments of the present invention. As shown in FIG. 1, the image forming apparatus 1 according to an exemplary embodiment of the present invention includes a conveying unit 2, and a plurality of image forming units (image forming means) 3M, 3Y, 3C, and 3BK that are disposed on the conveying unit 2 to electrostatically transfer a toner image onto a recording medium X. A fixing device 4 fuses and presses the toner image on the recording medium X to fix the toner image onto the recording medium X while carrying the recording medium X carrying the toner image.

First, the image forming units 3M, 3Y, 3C, and 3BK are described.

The image forming units 3M, 3Y, 3C, and 3BK charge a photosensitive drum (that is, image carrier) 6 and irradiate laser beams 11 onto the surface of the charged photosensitive drum 6 to expose the charged photosensitive drum 6. Thereafter, the image forming units 3M, 3Y, 3C, and 3BK develop a latent image formed by means of the exposure to form a toner image. Then, the image forming units 3M, 3Y, 3C, and 3BK transfer the toner image formed by means of the development to the recording medium X, which is conveyed by a transfer belt 10. The plurality of image forming units 3M, 3Y, 3C, and 3BK are sequentially disposed in a transfer direction of the transfer belt 10 and form respective toner images of magenta, yellow, cyan, and black colors. Each image forming unit 3M, 3Y, 3C, and 3BK includes a photosensitive drum 6, an exposing device (exposing means) 7, a developing device (developing means) 8, a charging roller 9, and a cleaning means 19.

The photo sensitive drum 6 is an example of an image carrier, which axially rotates in the direction indicated by the arrow shown in FIG. 1, and forms a latent image on the surface thereof by means of the laser beams 11 irradiated from the exposing device 7. The exposing device 7 scans the photosensitive drum 6 with the laser beam 11 concentrated onto micro spots along a straight line parallel to the rotation axis of the photosensitive drum 6.

The developing device 8 develops an electrostatic latent image to form a toner image. The developing device 8 attaches the toner to the surface of photosensitive drum 6 by frictionally charging a powder toner having a predetermined color with negative charges and supplying the toner to an exposed portion of the photosensitive drum 6 charged with positive charges in comparison with a non-exposed portion. The developing device 8 includes a toner, a stirrer 12*d* that stirs and charges the toner, a supply roller 12*c* that supplies the charged toner to a developing roller 12*a*, a developing roller 12*a* that attaches the toner supplied by the supply roller 12*c* to the surface with Coulomb's force and that supplies the toner to the vicinity of the photosensitive drum 6, and a developing blade 12*b* for regulating the thickness of the toner on the developing roller 12*a* to a constant thickness.

The cleaning means 19 includes a photosensitive-drum cleaning roller 19*a* that contacts the photosensitive drum 6 to remove the toner on the surface of the photosensitive drum 6 and a collection tank (not shown) that is disposed in the vicinity of the cleaning roller 19*a* to collect the toner removed by the cleaning roller 19*a*.

The charging roller 9 makes the surface potential of the photosensitive drum 6 a predetermined potential at the time of forming an image. The charging roller 9 includes a roller section made of an elastic member in which conductivity is given to a metal shaft and contacts the photosensitive drum 6 at a charging position downstream from the photosensitive-drum cleaning roller 19*a*. Then, pressing bearings (not shown) by means of an elastic bias means, such as a spring, press the charging roller 9 to the photosensitive drum 6 with a predetermined pressure. As a result, the roller section is deformed to form a nip section contacting the photosensitive drum 6 by a predetermined width in the circumferential direction thereof. Accordingly, when a DC voltage is applied to the charging roller 9, the surface of the photosensitive drum 6 is charged to a predetermined potential. Additionally, a charging-roller cleaning roller 20 contacts the charging roller 9 to remove contaminants on the surface of the charging roller 9.

Next, the conveying unit 2 is described.

The conveying unit 2 includes driven rollers 13*b* and 13*c* provided in an inner circumference of a transfer belt 10 that is circulated by a tension roller 14 and a driving roller 13*a*. A transfer roller 16*a* keeps the transfer belt 10 in contact with the photosensitive drum 6 at a transfer position. A belt cleaning unit 17 brings a cleaning blade into contact with the transfer belt 10 and scratches attachments on the surface of the transfer belt 10, and that has a space for collecting the scratched attachments.

The transfer belt 10 is made of a material that attracts the toner on the photosensitive drum 6 with a transfer voltage applied to the transfer roller 16*a* when the transfer belt 10 is opposed to the photosensitive drum 6 with the recording medium X therebetween. For example, the recording medium X may be a dielectric sheet. The transfer belt 10 preferably has a light reflecting characteristic.

In the transfer roller 16*a*, the roller section has a metal rotation shaft and conductive or semi-conductive synthetic rubber covers the metal rotation shaft. A high voltage source (not shown) is connected to the rotation axis to control the surface potential of the roller section.

Here, the transfer roller 16*a* and a control unit 16 for controlling the surface potential of the roller section constitute a transfer unit 18 that electrostatically transfers the toner image formed by the image forming units 3M, 3Y, 3C, and 3BK to the recording medium X conveyed by the transfer belt 10.

Next, a fixing device 4 according to a first exemplary embodiment of the present invention is described.

Figure 2:
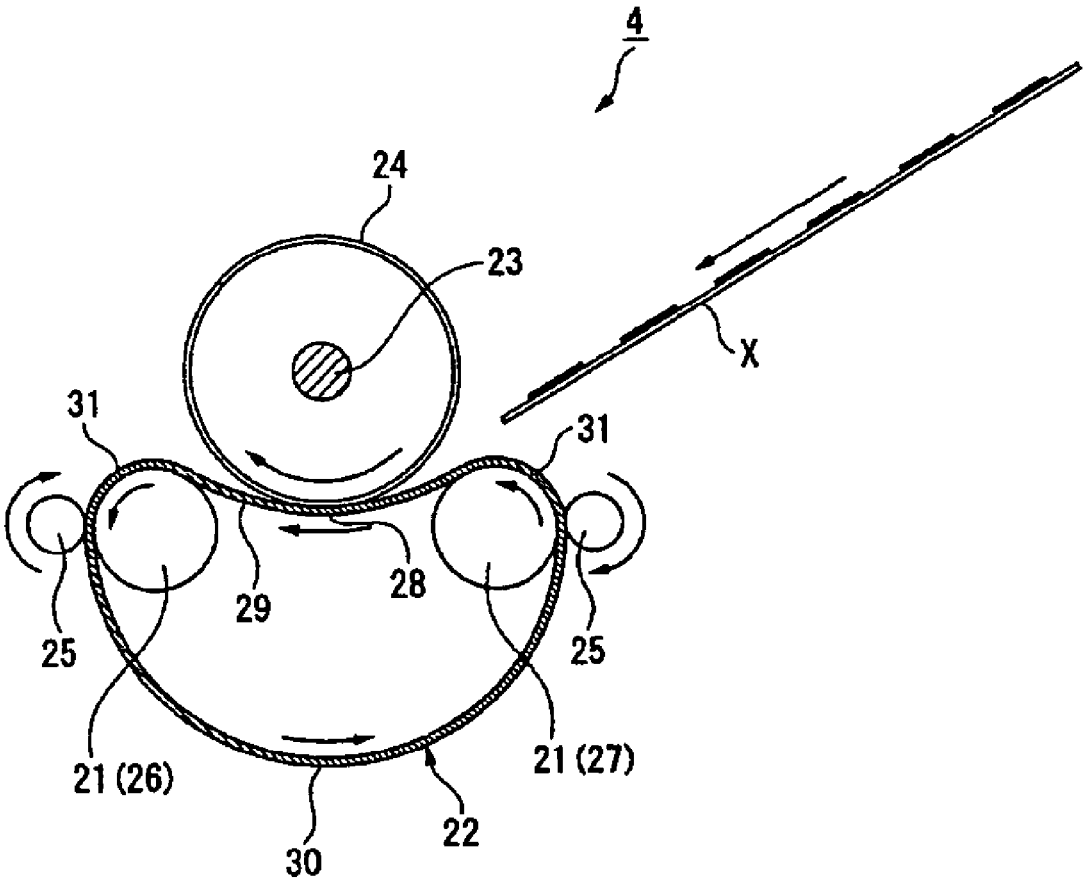
FIG. 2 is a schematic diagram of a fixing device according to a first exemplary embodiment of the present invention.

FIG. 2 is a schematic diagram illustrating the fixing device 4 according to the first exemplary embodiment of the present invention. As shown in FIG. 2, the fixing device 4 includes plural support members 21 (two support members in FIG. 2), a fixing belt 22 that is wound around the support members 21 and is supported to be movable in the circumferential direction thereof, a heating member 24 to be compressed to the fixing belt 22, a heat source 23 for heating the heating member 24, and pinch members 25 provided on the side surfaces of the respective support members 21.

Each support member 21 is preferably a cylinder-shaped member that axially rotates, and is disposed inside the fixing belt 22 such that the fixing belt 22 is suspended on the outer circumferential surfaces of the support members 21. The support members 21 are disposed in the vicinity of the heating member 24 to be spaced from the heating member 24, and are disposed upstream (at the right side in FIG. 2) and downstream (at the left side in FIG. 2) in the direction in which the recording medium X, is conveyed respectively. The downstream support member 21 is a driving roller 26 that axially rotates by means of a driving mechanism (not shown) and the upstream support member 21 is a guide roller 27 that gives the fixing belt 22 frictionally contacting the support member 21 a resistance to the circumferential movement of the fixing belt 22.

The fixing belt 22 is a member that has a small thickness and a cylinder shape in a state where no external force is applied to the fixing belt 22 and that has a length greater than the width of the recording medium X. The fixing belt 22 is supported by the driving roller 26 and the guide roller 27 provided therein. The fixing belt 22 is formed by stacking an elastic layer made of heat-resisting rubber, such as silicon, having a thickness of several hundreds μm on the outer circumference of a base layer made of a metal or heat-resisting resin film having a thickness of several tens of to 150 μm. Additionally, another layer made of fluoride resin or variants of the fluorine resin (such as polytetrafluoroethylene) having an excellent heat resistance and a thickness of several tens of μm may be stacked on the surface of the elastic layer.

The inner surface of the fixing belt 22 contacts the driving roller 26 and is moved in the circumferential direction by means of the driving roller 26 that axially rotates. Additionally, since the guide roller 27 (upstream support member 21) gives the fixing belt 22 the resistance to the circumferential movement, a first suspended portion 29 (upper suspended portion in FIG. 2) of suspended portions 29 and 30 of the fixing belt 22 suspended between the driving roller 26 and the guide roller 27 is hung in a tensile state with tension and a second suspended portion 30 (lower suspended portion in FIG. 2) is hung in a non-tensile state without tension.

The heating member 24 is preferably a cylinder-shaped member that axially rotates and that is made of a material having excellent thermal conductivity, such as aluminum, stainless steel, and iron. The surface of the heating member 24 is coated with fluoride resin or variants of the fluorine resin (such as polytetrafluoroethylene) having an excellent heat resistance to substantially prevent attachment of the toner. The heating member 24 always mechanically presses the central portion of the tensile suspended portion 29 in the longitudinal direction. Therefore, as seen in a cross-sectional view, a circle-shape fixing nip portion 28 is formed between the heating member 24 and the suspended portion 29. Additionally, since a normal direction force acts on the fixing nip portion 28 by means of the tension acting on the tensile suspended portion 29, the toner image carried on the recording medium X passing through the fixing nip portion 28 is pressed. Furthermore, the heating member 24, which is compressed to and frictionally contacts the outer circumferential surface of the fixing belt 22, axially rotates along with the fixing belt 22 that moves in the circumferential direction.

The heat source 23, such as a halogen lamp, has a body section that radiates heat and that is disposed inside the heating member 24. The heat source 23 heats the heating member 24 by means of radiant heat from the body section.

Each pinch member 25 is preferably a cylinder-shaped member that is disposed parallel to the support members 21 and that axially rotate. Each pinch member 25 is disposed outside the fixing belt 22 and in the vicinity of the corresponding support member 21. Therefore, the winding portion 31 of the fixing belt suspended on the support members 21 is sandwiched between the pinch members 25 and the support members 21. Additionally, the pinch members 22, which press the outer circumferential surface of the winding portion 31 of the fixing belt 22 and frictionally contact the outer circumferential surface of the fixing belt 22, axially rotate along with the fixing belt 22 that moves in the circumferential direction.

Operation of the image forming apparatus 1 having the above-mentioned structure is described. Because the entire operation of the image forming apparatus 1 is the same as well-known, conventional color printers or the like, the detailed description thereof is omitted and operation of the fixing device 4 is mainly described.

First, at the time point when the image forming apparatus 1 is activated, a pre-heating process is performed by activating the heat source 23. Specifically, the pre-heating process is performed until the temperature of the fixing device 4 reaches a predetermined fixing temperature. At this time, the driving roller 26 is allowed to axially rotate by means of a driving mechanism (not shown) and the fixing belt 22 is moved in the circumferential direction along with the rotation of the driving roller 26. The guide roller 27, the heating member 24, and the pinch members 25 axially rotate along with the movement of the fixing belt 22. Since the temperature of the image forming apparatus 1 is increased by the heat radiation from the fixing device 4, the inside of the image forming apparatus 1 is cooled by forcedly generating a convection around the fixing device 4 with a fan (not shown).

Next, at the time point when the temperature of the fixing device 4 reaches the predetermined fixing temperature, the image forming units 3M, 3Y, 3C, and 3BK perform a process of forming an image on the recording medium X conveyed by the transfer belt 10. Specifically, the deflected laser beam 11 is irradiated to the surface of the photosensitive drum 6 charged by the charging roller 9 to form a latent image, the latent image is then developed by the developing device 8 to form a toner image, and the toner image formed on the photosensitive drum 6 is transferred to the recording medium X conveyed over the transfer belt 10.

Next, when the recording medium X carrying the toner image is conveyed to the fixing device 4, a process of fusing and fixing the toner image to the recording medium X is performed while sandwiching and conveying the recording medium X with the fixing belt 22 and the heating member 24. Specifically, the recording medium X carrying the toner image is introduced into the fixing nip section 28 through the entrance (right side in FIG. 2). In the fixing nip section 28, the toner image carried on the recording medium X is fixed to the recording medium X by fusing the toner image by means of the heat of the heating member 24 and pressing the toner image toward the fixing belt 22. Then, the recording medium to which the toner image has been fixed is discharged through the exit (left side in FIG. 2).

In the fixing device 4 having the above-mentioned structure, since a relatively wide fixing nip section 28 is formed by compressing the heating member 24 to the tensile suspended portion 29 of the fixing belt 22, the fixing time may be increased, thereby obtaining a sufficient fixing ability. Additionally, because the fixing belt 22 has a low thermal capacity, it is possible to shorten the pre-heating time and to reduce the power consumption. Furthermore, since the suspended portion 30 that does not contact the heating member 24 is in a non-tensile state, the non-tensile suspended portion 30 of the fixing belt 22 may absorb the deformation of the fixing belt 22 itself or the deviation of the fixing belt 22 due to the deformation of the sectional shape of the support members 21. Therefore, it is possible to substantially prevent the movement of the fixing belt 22 in the axial direction of the support members 21. Additionally, since the fixing device 4 is constructed without using expensive components, it is very economical.

Furthermore, since the pinch members 25 are disposed at the side surfaces of the support members 21 and the fixing belt 22 is sandwiched between the support members 21 and the pinch members 25, the first suspended portion 29 of the fixing belt 22 may be made in a tensile state and the second suspended portion 30 may be made in a non-tensile state.

Because the fixing device 4 according to the first exemplary embodiment of the present invention has a short pre-heating time, low power consumption, decreased deviation of the belt, and low-cost components, it is possible to provide the image forming apparatus 1 in which the pre-heating time is shortened, the power consumption is reduced, and mechanical problems do not easily occur, with low cost.

Additionally, since the two support members 21 supporting the fixing belt 22 include the driving roller 26 and the guide roller 27 are axially rotatable and the heating member 24 compressed to the first suspended portion 29 of the fixing belt 22 is in a roller shape that is axially rotatable, no member slides on the fixing belt 22 and thus the fixing belt 22 does not wear.

SECOND EXEMPLARY EMBODIMENT

A fixing device and an image forming apparatus according to a second exemplary embodiment of the present invention are described. In the second exemplary embodiment, elements having the same structures as those of the first exemplary embodiment are not described.

Figure 3:
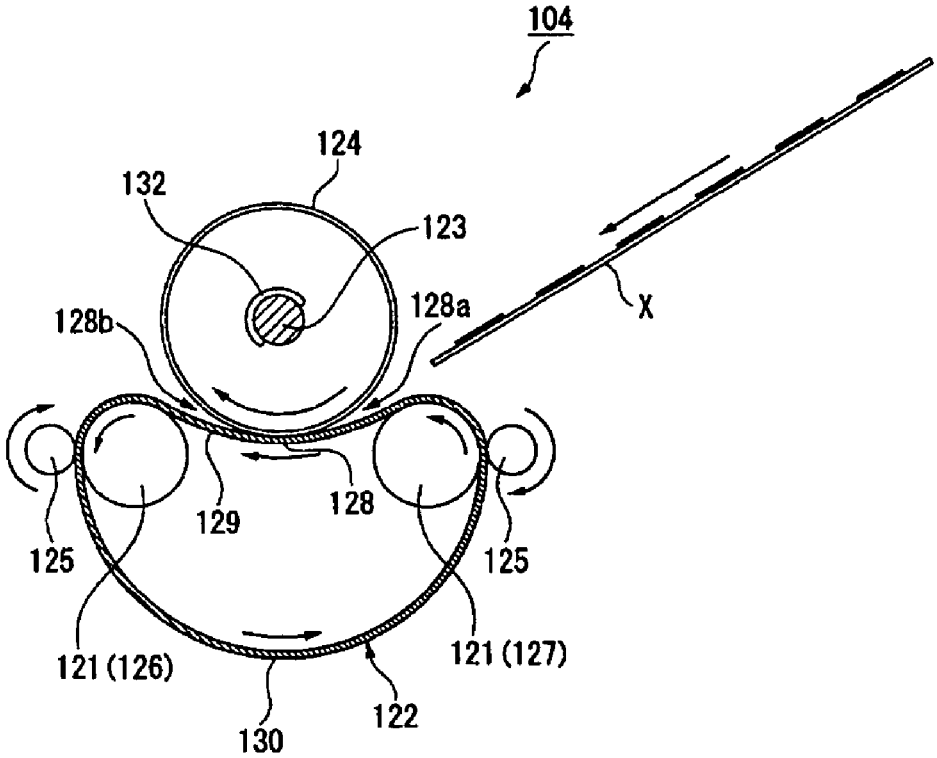
FIG. 3 is a schematic diagram of a fixing device according to a second exemplary embodiment of the present invention.

FIG. 3 is a schematic diagram of a structure of the fixing device 104 according to the second exemplary embodiment of the present invention. In the second exemplary embodiment shown in FIG. 3, as seen in a cross-sectional view, the body section of the heat source 23 in the first exemplary embodiment is covered with a directional cover 132 of a circular arc shape. That is, the fixing device 104 includes plural support members 121 (two support members in FIG. 3), a fixing belt 122 wound on the support members and supported to be movable in the circumferential direction thereof, a heating member 124 compressed to the fixing belt 122, a heat source 123 that heats the heating member 124 and is covered with a directional cover 132 of a substantially circular arc shape, and pinch members 125 disposed at the side surfaces of the support members 121. The structure, other than the directional cover 132, is substantially the same as that of the first exemplary embodiment described above.

The heat source 123 is preferably a member, such as a halogen lamp, of which the body section emitting heat is disposed inside the heating member 124 and that heats the heating member 124 by means of radiant heat from the body section. The body section of the heat source 123 is covered with the directional cover 132 of a substantially circular arc shape as seen in a cross-sectional view. The directional cover 132 is opened toward an entrance 128*a* of the fixing nip section 128 and concentrates the radiant heat of the heat source 123 on the entrance 128*a* of the fixing nip section 128. In the heating member 124 heated by means of the radiant heat of the heat source 123, the portion upstream from the fixing nip section 128 is concentrically heated due to the directional cover 132 and a temperature gradient that decreases from upstream to downstream is given to the fixing nip section 128. A thermistor (not shown) may be provided for detecting the temperature of the fixing belt 122 may be provided and a temperature control means for turning on and off the heat source 123 on the basis of the temperature detected by the thermistor.

In the fixing device 104 having the above-mentioned structure, the upstream portion of the fixing belt 122 is concentrically heated by means of the radiant heat from the heat source 123 to which a directional characteristic is given by the directional cover 132. It is difficult to heat the downstream portion of the fixing belt 122 in comparison with the upstream portion because the downstream portion is shielded by the directional cover 132. Therefore, the temperature of an exit 128*b* of the fixing nip section 128 is lower than that of the entrance 128*a*, and thus the temperature of the fixing nip section 128 is gradually lowered from the entrance 128*a* to the exit 128*b*. That is, because the temperature gradient decreases from upstream to downstream in the fixing nip section 128, the toner image is heated at a relatively high temperature when the toner image carried on the recording medium X passes through the entrance 128*a* of the fixing nip section 128. Accordingly, the toner image may be heated and fused until the toner image reaches the viscosity with which the toner image is not attached to the outer surface of the heating member 124, thereby preventing the cold off-set. Additionally, the toner image is heated at a relatively low temperature when the toner image passes through the exit 128*b* of the fixing nip section 128. Accordingly, the toner image may have a cohesive force with which it is not separated, thereby preventing the hot off-set.

The heating by the heat source 123 may be adjusted using the temperature control means (not shown) provided in the fixing device 104 such that the entrance 128*a* of the fixing nip section 128 is kept at a temperature at which the cold off-set does not occur and the exit 128*b* of the fixing nip section 128 is kept at a temperature at which the hot off-set does not occur.

The fixing device 104 according to the second exemplary embodiment described above is specifically advantageous for apparatuses corresponding to colour printing, because the off-set phenomena may easily occur when a colour toner image that is formed by overlapping a plurality of colours (magenta, yellow, cyan, and black) with each other.

THIRD EXEMPLARY EMBODIMENT

A fixing device and an image forming apparatus according to a third exemplary embodiment of the present invention is described. In the third exemplary embodiment, elements having the same structure as the first or second exemplary embodiments are not described.

Figure 4:
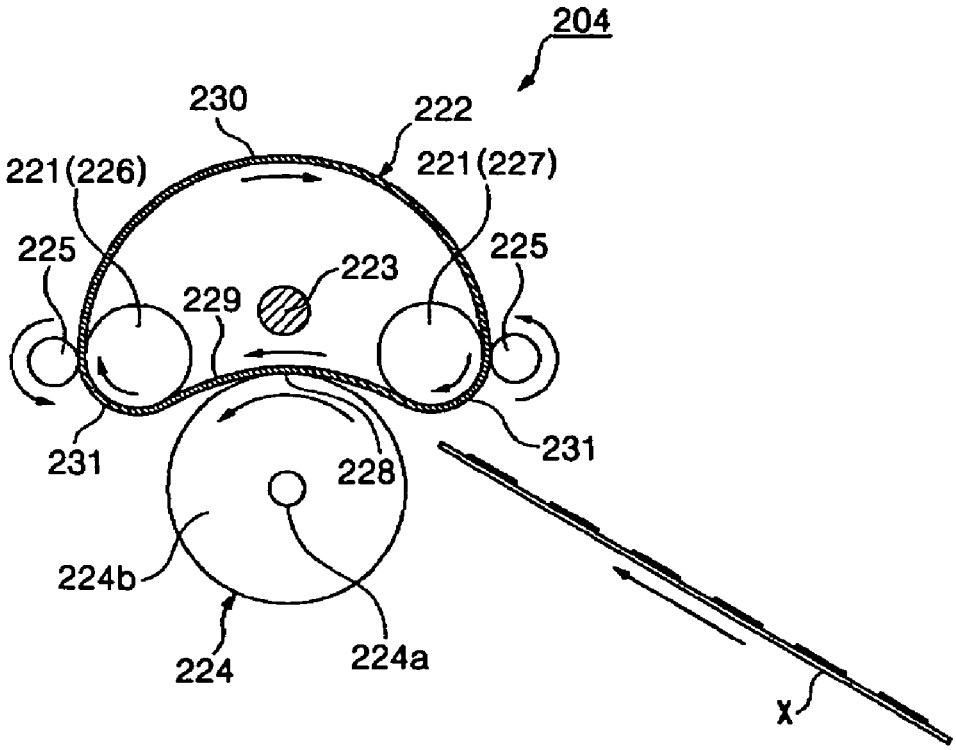
FIG. 4 is a schematic diagram of a fixing device according to a third exemplary embodiment of the present invention.

FIG. 4 is a schematic diagram of a structure of the fixing device 204 according to the third exemplary embodiment of the present invention. In the third exemplary embodiment shown in FIG. 4, the structure including the support members 21, the fixing belt 22, and the pinch members 25 in the first exemplary embodiment are replaced with a pressing member 224 of a cylinder shape and the heat member 24 in the first exemplary embodiment is replaced with a structure including support members 221, a fixing belt 222, and pinch members 225.

The fixing device 204 according to the third exemplary embodiment of the present invention includes plural support members 221 (two support members in FIG. 4), a fixing belt 222 wound on the support members 221 and supported to be movable in the circumferential direction, a heat source 223 heating the fixing belt 222, a pressing member 224 compressed to the fixing belt 222, and pinch members 225 provided at the side surfaces of the support members 221.

Each support member 221 is a cylinder-shaped member that axially rotates and is disposed inside the fixing belt 222. That is, the fixing belt 222 is suspended on a part of the outer circumferential surface of each support member 221. The support members 221 are disposed in the vicinity of the pressing member 224 with the pressing member 224 therebetween and are disposed upstream (right side in FIG. 4) and downstream (left side in FIG. 4) in the direction in which the recording medium X is conveyed, respectively. The downstream support member 221 is a driving roller 226 that axially rotates by means of a driving mechanism (not shown) and the upstream support member 221 is a guide roller 227 that gives the fixing belt 222 frictional contact with the upstream support member 221 with a rotational resistance to the circumferential movement of the fixing belt 222.

The fixing belt 222 is preferably a thin member that has a cylinder shape when no external force is applied to the fixing belt 222 and that has a length greater than the width of the recording medium X. The fixing belt 222 is supported by the driving roller 226 and the guide roller 227 provided therein. The fixing belt 222 is preferably formed by stacking an elastic layer made of heat-resisting rubber, such as silicon, having a thickness of several hundreds of μm on the outer circumference of a base layer made of a metal or heat-resisting resin film having a thickness of several tens of to 150 μm. Additionally, another layer made of fluoride resin or variants of the fluorine resin (such as polytetrafluoroethylene) having an excellent heat resistance and a thickness of several tens of μm may be stacked on the surface of the elastic layer.

The inner surface of the fixing belt 222 frictionally contacts the driving roller 226 and is moved in the circumferential direction by means of the axially rotating driving roller 26. Additionally, because the guide roller 227 (upstream support member 221) gives the fixing belt 222 resistance to the circumferential movement, a first suspended portion 229 (lower suspended portion in FIG. 4) of suspended portions 229 and 230 of the fixing belt 222 suspended between the driving roller 226 and the guide roller 227 is hung in a tensile state with tension and a second suspended portion 230 (upper suspended portion in FIG. 4) is hung in a non-tensile state without tension.

The heat source 223, such as a halogen lamp, has a body section that radiates heat and that is disposed inside the fixing belt 222. The heat source 223 heats the fixing belt 222 by means of the radiant heat from the body section. For example, the body section of the heat source 223 is disposed in the vicinity of a fixing nip section 228 formed between the fixing belt 222 and the pressing member 224.

The pressing member 224 is a cylinder-shaped member that axially rotates and has a structure that a metal core 224*a* is coated with a heat-resisting layer 224*b*, such as silicon rubber. The pressing member 224 mechanically presses the longitudinal center of the tensile suspended portion 229. As seen in a cross-sectional view, the fixing nip section 228 of a substantially circular arc shape is formed between the pressing member 224 and the first suspended portion 229. Additionally, since a normal direction force acts on the fixing nip section 228 due to the tension acting on the tensile suspended portion 229, the toner image carried on the recording medium X passing through the fixing nip section 228 is pressed. Furthermore, the pressing member 224, which frictionally contacts the outer circumferential surface of the fixing belt 222, axially rotates along with the fixing belt 222 that moves in the circumferential direction.

Each pinch member 225 is a cylinder-shaped member that is disposed parallel to the support members 221 and that axially rotate. Each pinch member 225 is disposed outside the fixing belt 222 and in the vicinity of the corresponding support member 221. Therefore, the winding portion 231 of the fixing belt 222 suspended on the support members 221 is sandwiched between the pinch members 225 and the support members 221. Additionally, the pinch members 222, which press the outer circumferential surface of the winding portion 231 of the fixing belt 222 and frictionally contact the outer circumferential surface of the fixing belt 222, axially rotate along with the fixing belt 222 that moves in the circumferential direction.

Operation of the fixing device 204 having the above-mentioned structure is described.

First, at the time point when the image forming apparatus 1 is activated, a pre-heating process is performed by activating the heat source 223. Specifically, the pre-heating process is performed until the temperature of the fixing device 204 reaches a predetermined fixing temperature. At this time, the driving roller 226 is allowed to axially rotate by means of a driving mechanism (not shown) and the fixing belt 222 is moved in the circumferential direction along with the rotation of the driving roller 226. The guide roller 227, the pressing member 224, and the pinch members 225 axially rotate along with the movement of the fixing belt 222.

Next, when the recording medium X carrying the toner image is conveyed to the fixing device 204, a process of fusing and fixing the toner image to the recording medium X is performed while interposing and conveying the recording medium X with the fixing belt 222 and the pressing member 224. Specifically, the recording medium X carrying the toner image is introduced into the fixing nip section 228 through the entrance (right side in FIG. 4). In the fixing nip section 228, the toner image carried on the recording medium X is fixed to the recording medium X by fusing the toner image by means of the heat of the fixing belt 222 and pressing the toner image with the pressing member 224. Then, the recording medium X to which the toner image has been fixed is discharged through the exit (left side in FIG. 4).

In the fixing device 204 having the above-mentioned structure, because a relatively wide fixing nip section 228 is formed by compressing the pressing member 224 to the tensile suspended portion 229 of the fixing belt 222, the fixing time is increased, thereby obtaining a sufficient fixing ability. Additionally, since the fixing belt 222 has a low thermal capacity, it is possible to shorten the pre-heating time and to reduce the power consumption. Furthermore, since the suspended portion 230 that does not contact the pressing member 224 is in a non-tensile state, the non-tensile suspended portion 230 of the fixing belt 222 absorbs the deformation of the fixing belt 222 itself or the deviation of the fixing belt 222 due to the deformation of the sectional shape of the support members 221. Therefore, it is possible to substantially prevent the movement of the fixing belt 222 in the axial direction of the support members 221.

Because the fixing device 204 according to the exemplary embodiment of the present invention has a short pre-heating time, low power consumption, decreased deviation of the belt, and low-cost components, it is possible to provide the image forming apparatus 1 in which the pre-heating time is shortened, the power consumption is reduced, and mechanical problems do not easily occur, with low cost. Additionally, since two support members 221 supporting the fixing belt 222 include the driving roller 226 and the guide roller 227 are axially rotatable and the pressing member 224 compressed to the suspended portion 229 of the fixing belt 222 is in a roller shape axially rotatable, no member slides on the fixing belt 222 and thus the fixing belt 222 does not wear.

FOURTH EXEMPLARY EMBODIMENT

Now, a fixing device and an image forming apparatus according to a fourth exemplary embodiment of the present invention are described. In the fourth exemplary embodiment, elements having the same structures as the first to third exemplary embodiments are not described.

Figure 5:
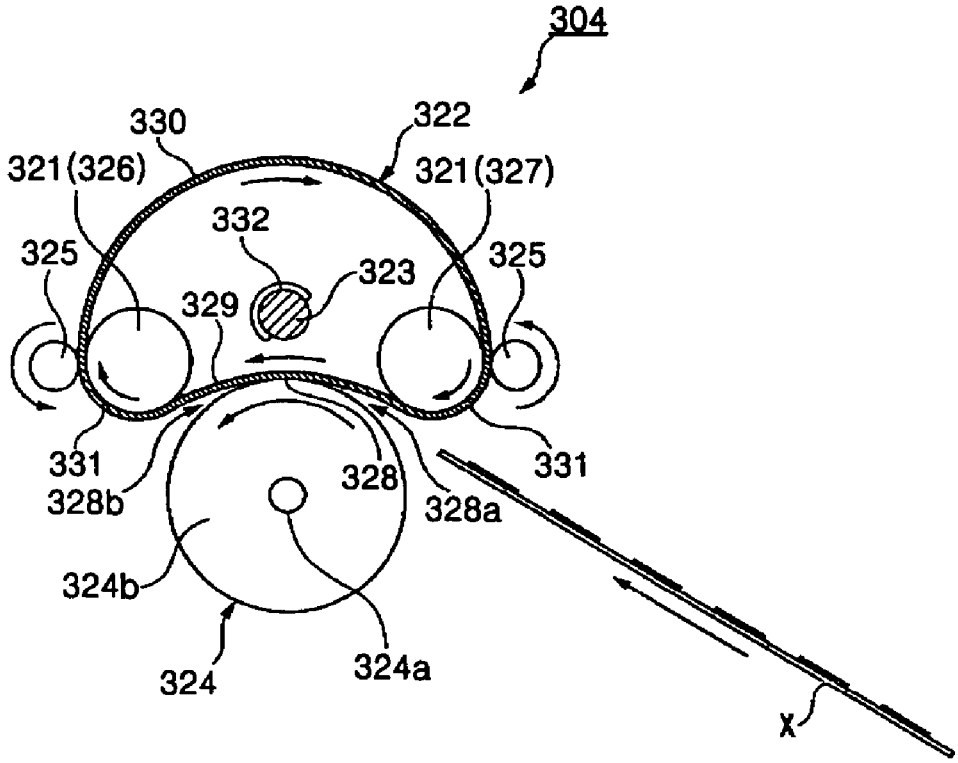
FIG. 5 is a schematic diagram of a fixing device according to a fourth exemplary embodiment of the present invention.

FIG. 5 is a schematic diagram illustrating a structure of the fixing device 304 according to the fourth exemplary embodiment of the present invention. In the fourth exemplary embodiment shown in FIG. 5, the body section of the heat source 223 in the third exemplary embodiment is covered with a directional cover 332 of a circular arc shape as seen in a cross-sectional view. That is, the fixing device 304 according to the fourth exemplary embodiment of the present invention includes plural support members 321 (two support members in FIG. 5), a fixing belt 322 wound on the support members 321 and supported to be movable in the circumferential direction, a heat source 323 that heats the fixing belt 322 and that is covered with a directional cover 332 of a substantially circular arc shape, a pressing member 324 compressed to the fixing belt 322, and pinch members 325 provided at the side surfaces of the support members 321, respectively. The structure, other than the directional cover 332, is substantially the same as that of the third exemplary embodiment.

The heat source 323 is a member, such as a halogen lamp, of which the body section emitting heat is disposed inside the fixing belt 322 and that heats the fixing belt 322 by means of radiant heat from the body section. The body section of the heat source 323 is disposed right over a fixing nip section 328 formed between the fixing belt 322 and the pressing member 324. The body section of the heat source 323 is covered with the directional cover 332 of a substantially circular arc shape as seen in a cross-sectional view. The directional cover 332 is opened toward an entrance 328*a* of the fixing nip section 328 and concentrates the radiant heat of the heat source 323 on the entrance 328*a* of the fixing nip section 328. In the fixing belt 322 heated by the radiant heat of the heat source 323, the portion upstream from the fixing nip section 328 is concentrically heated due to the directional cover 332 and a temperature gradient decreases from upstream to downstream of the fixing nip section 328. A thermistor (not shown) for detecting the temperature of the fixing belt 322 may be provided and a temperature control means for turning on and off the heat source 323 on the basis of the temperature detected by the thermistor may be provided.

In the fixing device 304 having the above-mentioned structure, the upstream portion of the fixing belt 322 is concentrically heated by the radiant heat of the heat source 323, which is given a directional characteristic by the directional cover 332. It is difficult to heat the downstream portion of the fixing belt 322 in comparison with the upstream portion because the downstream portion is shielded by the directional cover 332. Therefore, the temperature of an exit 328*b* of the fixing nip section 328 is lower than that of the entrance 328*a* and thus the temperature of the fixing nip section 328 is gradually lowered from the entrance 328*a* to the exit 328*b*. That is, because the temperature gradient decreases from upstream to downstream of the fixing nip section 328, the toner image is heated at a relatively high temperature when the toner image carried on the recording medium X passes through the entrance 328*a* of the fixing nip section 328. Accordingly, the toner image may be heated and fused until the toner image reaches the viscosity with which the toner image is not attached to the outer surface of the fixing belt 322, thereby preventing the cold off-set. Additionally, the toner image is heated at a relatively low temperature when the toner image passes through the exit 328*b* of the fixing nip section 328. Accordingly, the toner image may have a cohesive force with which it is not separated, thereby preventing the hot off-set.

Similarly to the second exemplary embodiment, the heating by the heat source 323 may be adjusted using the temperature control means (not shown) provided in the fixing device 304, such that the entrance 328*a* of the fixing nip section 328 is kept at a temperature at which the cold off-set does not occur and the exit 328*b* of the fixing nip section 328 is kept at a temperature at which the hot off-set does not occur.

FIFTH EXEMPLARY EMBODIMENT

A fixing device and an image forming apparatus according to a fifth exemplary embodiment of the present invention are described. In the fifth exemplary embodiment, elements having substantially the same structures as the first to fourth exemplary embodiments are not described.

Figure 6:
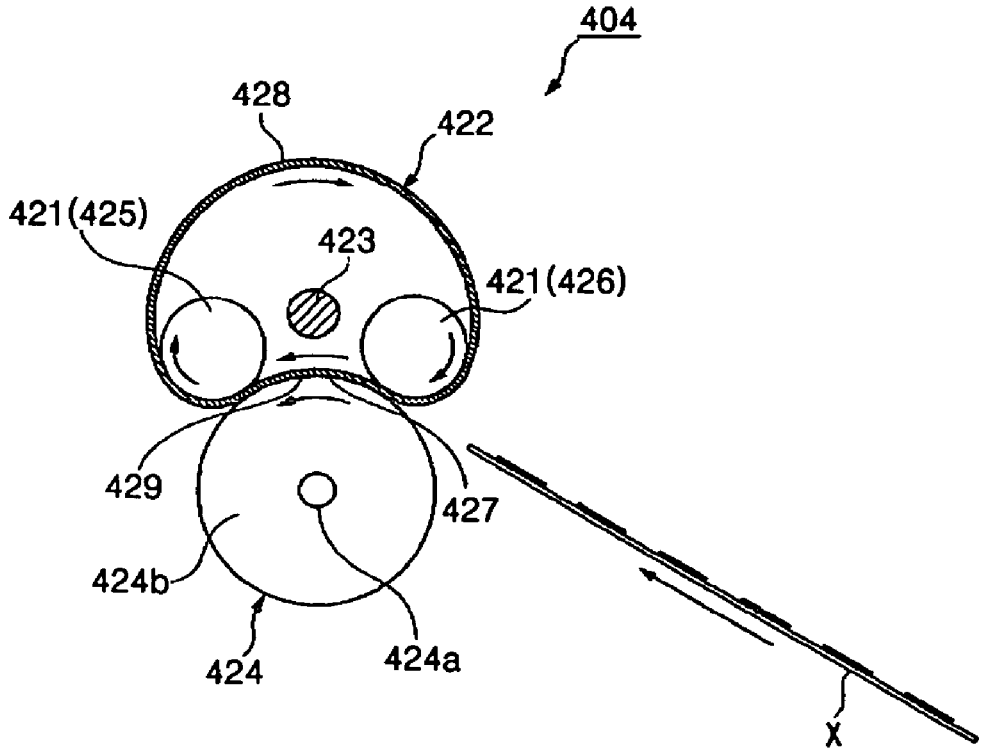
FIG. 6 is a schematic diagram of a fixing device according to a fifth exemplary embodiment of the present invention.

FIG. 6 is a schematic diagram of a structure of the fixing device 404 according to the fifth exemplary embodiment of the present invention. In the fifth exemplary embodiment, the pinch members 225 in the third exemplary embodiment are omitted and the support members 221 and the pressing member 224 in the third exemplary embodiment are compressed to each other with the fixing belt 222 therebetween.

As shown in FIG. 6, the fixing device 404 according to the fifth exemplary embodiment of the present invention includes plural support members 421 (two support members in FIG. 6), a fixing belt 422 wound on the support members 421 and supported to be movable in the circumferential direction, a heat source 423 disposed inside the fixing belt 422 along with the support members 421 to heat the fixing belt 422 from the inside thereof, and a pressing member 424 pressed onto the support members 421 and thus compressed to the fixing belt 422.

Each support member 421 is preferably a cylinder-shaped member that axially rotates and is disposed inside the fixing belt 422. The two support members 421 are compressed to the pressing member 424 with the fixing belt 422 therebetween upstream (at the right side in FIG. 6) and downstream (at the left side in FIG. 6) in the direction in which the recording medium X is conveyed (the rotation direction of the pressing member 424), respectively. The downstream support member 421 is a driving roller 425 that axially rotates by means of a driving mechanism (not shown) and the upstream support member 421 is a guide roller 426 that has a rotational resistance and gives a resistance to the circumferential movement of the fixing belt 422 by means of the rotational resistance.

The driving roller 425 and the guide roller 426 disposed inside the fixing belt 422 are compressed to the pressing member 424, whereby the fixing belt 422 is sandwiched and supported between the driving roller 425 and the pressing member 424 and between the guide roller 426 and the pressing member 424, respectively. Therefore, the inner surface of the fixing belt 422 frictionally contacts the driving roller 425 and the guide roller 426 and the fixing belt 422 is movable in the circumferential direction along with the driving roller 425 that axially rotates.

In such a structure, by rotating the driving roller 425, a first suspended portion 427 (lower suspended portion of FIG. 6) close to the pressing member 424 of suspended portions 427 and 428 of the fixing belt 422 suspended between the driving roller 425 and the guide roller 426 is hung in a tensile state with tension while both ends of the suspended portion 427 are sandwiched between the driving roller 425 and the pressing member 424 and between the guide roller 426 and the pressing member 424. A second suspended portion 428 (upper suspended portion in FIG. 6) is hung in a non-tensile state without tension.

The heat source 423, such as a halogen lamp, has a body section that radiates heat and that is disposed inside the fixing belt 422. The heat source 423 heats the fixing belt 422 by means of the radiant heat from the body section. For example, the body section of the heat source 423 is disposed in the vicinity of a fixing nip section 429 formed by bringing the tensile suspended portion 427 of the fixing belt 422 and the pressing member 424 into contact with each other.

The pressing member 424 is preferably a cylinder-shape member that axially rotates and has a metal core 424*a* coated with a heat-resisting layer 424*b* made of silicon rubber or the like. The pressing member 424 is compressed to the tensile suspended portion 427 of which both ends have been sandwiched by the driving roller 425 and the guide roller 426. The fixing nip section 429 is formed between the tensile suspended portion 427 and the pressing member 424. Additionally, because a normal directional force acts on the fixing nip section 429 due to the tension acting on the tensile suspended portion 427, the toner image carried on the recording medium X passing through the fixing nip section 429 may be pressed. Furthermore, the pressing member 424, which frictionally contacts the outer circumferential surface of the fixing belt 422, axially rotates along with the fixing belt 422 that moves in the circumferential direction.

Operation of the fixing device 404 having the above-mentioned structure and the image forming apparatus 1 having the fixing device 404 are described.

First, at the time point when the image forming apparatus 1 is activated, a pre-heating process is performed by activating the heat source 423. Specifically, the pre-heating process is performed until the temperature of the fixing device 404 reaches a predetermined fixing temperature. At this time, the driving roller 425 is allowed to axially rotate by means of a driving mechanism (not shown) and the fixing belt 422 is moved in the circumferential direction by means of the rotation of the driving roller 425. When the fixing belt 422 is moved, the guide roller 426 and the pressing member 424 also axially rotate by means of the movement of the fixing belt 422.

Then, when the recording medium X carrying the toner image is conveyed to the fixing device 404, a process of fusing and fixing the toner image to the recording medium X is performed while sandwiching and conveying the recording medium X with the fixing belt 422 and the pressing member 424. Specifically, with the circumferential movement of the fixing belt 422, the recording medium X carrying the toner image is introduced into the fixing nip section 429 while being sandwiched between the fixing belt 422 and the pressing member 424 through the entrance of the fixing nip section 429 (right side of the fixing nip section 429 in FIG. 6) in which the pressing member 424 and the fixing belt 422 contact each other by means of the guide roller 426. In the fixing nip section 429, the toner image carried on the recording medium X is fixed to the recording medium X by fusing the toner image by means of the heat of the fixing belt 422 and pressing the toner image with the pressing member 424. Then, the recording medium X to which the toner image has been fixed is discharged through the exit (left side of the fixing nip section 429 in FIG. 6) in which the pressing member 424 and the fixing belt 422 come in close contact with each other by means of the driving roller 425.

In the fixing device 404 having the above-mentioned structure, because a relatively wide fixing nip section 429 is formed by compressing the pressing member 424 to the tensile suspended portion 427 of the fixing belt 422 that moves in the circumferential direction, the fixing time may be increased, thereby obtaining a sufficient fixing ability. Additionally, since the fixing belt 422 has a low thermal capacity, it is possible to shorten the pre-heating time and to reduce the power consumption. Furthermore, since the upstream and downstream sides of the fixing nip section 429 are compressed by the support members 421 and the pressing members 424, it is possible to surely maintain the length range and the compressing force of the fixing nip section 429 without being influenced by vibration and the like of the fixing belt 422. Furthermore, since the suspended portion 428 that does not contact the pressing member 424 is in a non-tensile state, the non-tensile suspended portion 428 may absorb the deformation of fixing belt 422 itself or the deviation of the fixing belt 422 due to the deformation of the sectional shape of the support member 421. Therefore, it is possible to substantially prevent the movement of the fixing belt 422 in the axial direction of the support members 421. Additionally, since the fixing device 404 is constructed without using expensive components, it is very economical.

Hitherto, the fixing device and the image formation apparatus according to the first to fifth exemplary embodiments of the present invention have been described. However, the present invention is not limited to the above-mentioned exemplary embodiments, but may be properly modified without departing from the gist of the invention. For example, although the heat source is disposed inside the heating member to be spaced from the inner circumferential surface and the heating member is heated by means of the radiant heat from the heat source in the first and second exemplary embodiments, the heat source may be disposed upstream outside the heating member or the heat source may be brought into contact with the heating member to directly heat the heating member, where the position of the heating source may be properly changed. Although the heat source is disposed inside the fixing belt to be spaced from the inner circumferential surface in the third to fifth exemplary embodiments, the heat source may be disposed inside the upstream support member and the support member may be heated by means of the radiant heat from the heat source, thereby heating the fixing belt by means of the heat of the heated support members.

In the second exemplary embodiment, the temperature gradient lowering from upstream to downstream has been given to the fixing nip section by covering the heat source disposed inside the heating member to be spaced from the inner circumferential surface of the heating member with the directional cover for concentrating the radiant heat on the entrance of the fixing nip section. However, the heat source may be disposed upstream outside the heating member or the heating source may be brought into contact with the heating member upstream to directly heat the heating member.

In the fourth exemplary embodiment, the temperature gradient lowering from upstream to downstream has been given to the fixing nip section by covering the heat source disposed inside the fixing belt to be spaced from the inner circumferential surface thereof with the directional cover for concentrating the radiant heat on the entrance of the fixing nip section. However, in the present invention, the temperature gradient that lowers from upstream to downstream may be given to the fixing nip section by providing a heat source for directly or indirectly heating the upstream support member and delivering the heat of the heated support member to the upstream belt contacting the support member. Additionally, the temperature gradient that lowers from upstream to downstream may be given to the fixing nip section by providing a heat source for directly or indirectly heating the pinch member opposed to the upstream support member and delivering the heat of the heated pinch member to the upstream belt contacting the pinch member. Furthermore, the temperature gradient lowering from upstream to downstream may be given to the fixing nip section by bringing the heat source into direct contact with the upstream belt and heating the belt.

Although two support members are provided upstream and downstream in the above-mentioned exemplary embodiments, respectively, three or more support members may be provided and another support member the upstream and downstream support members may be a guide roller and the other may be a driving roller.

In the above-mentioned embodiments, since the guide roller (upstream support member) having a rotational resistance gives the resistance to the movement of the fixing belt in the circumferential direction, one suspended portion is tensile, and the other suspended portion is non-tensile. However, in the present invention, by providing a driving mechanism that allows the upstream and downstream support members to axially rotate, allowing the downstream support member to axially rotate at a linear velocity greater than the linear velocity of the upstream support member, forming the outer circumference surface of the upstream support member smoother than the outer circumference surface of the downstream support member, and establishing that the frictional force between the belt and the downstream support member is greater than the frictional force between the belt and the upstream support member, one suspended portion may have a tension and the other suspended portion may not have a tension.

Although the support member is preferably a roller-shaped member that axially rotates in the above-mentioned exemplary embodiments, the present invention may be constructed such that a support member having a circular arc shape in a cross-sectional view is fixed and the belt is allowed to slide over the support member, where the shape may be properly changed.

Although the heating member is preferably a roller-shaped member that may axially rotate in the first and second exemplary embodiments, the present invention may be constructed such that a heating member having a circular arc shape in a cross-sectional view is fixed and the belt is allowed to slide over the heating member, where the shape may be properly changed.

Although the pressing member is preferably a roller-shaped member that axially rotates in the third to fifth exemplary embodiments, the present invention may be constructed such that a pressing member having a circular arc shape in a cross-sectional view is fixed and the belt is allowed to slide over the pressing member, where the shape may be properly changed.

Although the pinch members are preferably roller-shaped members that axially rotate in the first to fourth exemplary embodiments, the present invention may be constructed such that pinch members having a circular arc shape in a cross-sectional view are fixed and the belt is allowed to slide over the pinch members, where the shape may be properly changed.

Further, although the pinch members have been disposed at the side surfaces of the support members in the first to fourth exemplary embodiments, the pinch members may be omitted.

Furthermore, although both support members and the heating member have been spaced from each other in the first and second exemplary embodiments, the present invention may be constructed such that the support members and the heating member may be compressed to each other upstream and downstream. As a result, it is possible to surely maintain the length range and the compressing force therebetween without being influenced of vibration and the like of the belt. The support members and the heating member may be compressed to each other at any one of the upstream and downstream sides. As a result, it is possible to give a pressure gradient to the fixing nip section and thus to more surely fix the toner image onto the recording medium.

Although it has been described in the above-mentioned exemplary embodiments that the image forming apparatus 1 including a plurality of image forming units 3M, 3Y, 3C, and 3BK and corresponding to colour print, the image forming apparatus according to exemplary embodiments of the present invention may be used for white and black print in which only one image forming unit is provided. Furthermore, since the fixing nip section is wide and thus the heating and fusing time is increased, the exemplary embodiments of the present invention are particularly useful for colour printing for fixing a color toner image that is not easily fused.

Furthermore, the recording medium X is not limited to a sheet shape but may be a recording medium of a plate shape, where the shape and material of the recording medium may be properly changed.

Advantages

According to the exemplary embodiments of the present invention, the wide fixing nip section is formed between two support members by compressing the heating member or the pressing member to the tensile suspended portion of the belt that is suspended between the two support members. As a result, the fixing time may be increased, thereby obtaining a sufficient fixing ability. Additionally, since the belt to be heated has a low thermal capacity, it is possible to shorten the pre-heating time and to reduce the power consumption. Since the suspended portion not contacting the heating member or the pressing member is in a non-tensile state, the non-tensile suspended portion may absorb the movement of the belt due to the deformation of the belt or the deformation of the sectional shape of the support members, thereby substantially preventing movement of the belt in the axial direction of the support members. Since the present invention is constructed without using expensive components, it is economically advantageous.

According to the second and fourth exemplary embodiments of the present invention, since the temperature gradient that lowers from upstream to downstream is given to the fixing nip section from the heat source, the toner image is heated at a relatively high temperature when the recording medium carrying the toner image passes through the entrance of the fixing nip section. Therefore, since the toner image is fused to the viscosity with which it is not attached to the belt, it is possible to prevent the cold off-set. The toner image is heated at a relatively low temperature when the recording medium carrying the toner image passes through the exit of the fixing nip section. Accordingly, since the toner image has a cohesive force with which it is not separated, it is also possible to prevent the hot off-set.

Furthermore, according to the fifth exemplary embodiment of the present invention, since the upstream portion and the downstream portion of the fixing nip section are compressed to the support members and the pressing member, respectively, it is possible to surely maintain the length range and the compressing force without influence of the vibration and the like of the fixing belt.

According to the exemplary embodiments of the present invention, since the pinch members are disposed at the side surfaces of the support members and the belt is sandwiched by the support members and the pinch members, one suspended portion of the belt may be in a tensile state and the other suspended portion may be in a non-tensile state.

Furthermore, according to the exemplary embodiments of the present invention, since the support members and the heating member or the pressing member are compressed to each other upstream and downstream, respectively, it is possible to surely maintain the length range and the compressing force without influence of the vibration and the like of the fixing belt.

Furthermore, according to the exemplary embodiments of the present invention, since the heating member or the pressing member is compressed to the support members upstream or downstream, the pressure gradient may be given to the fixing nip section, thereby more surely fixing the toner image to the recording medium.

Furthermore, according to the exemplary embodiments of the present invention, since the fixing device has a short pre-heating time, low power consumption, decreased deviation of the belt, and low-cost components, it is possible to provide the image forming apparatus in which the pre-heating time is shortened, the power consumption is reduced, and mechanical problems do not easily occur, with low cost.

The foregoing exemplary embodiments and advantages are merely exemplary and are not to be construed as limiting the present invention. The present teaching may be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A fixing device, comprising:

at least two rotable support members;

a belt wound on the support members and supported to be movable in a circumferential direction of the support members;

a heating member compressed to the belt;

a heat source adapted to heat the heating member; and a fixing nip section formed between the belt and the heating member through which a recording medium carrying a toner image passes to heat and fix a toner image onto the recording medium, wherein among suspended portions of the belt suspended between the support members, a first suspended portion is in a tensile state, a second suspended portion is in a non-tensile state, and the heating member contacts the outside of the tensile suspended portion to form the fixing nip section.

2. The fixing device according to claim 1, wherein a temperature gradient is provided by the heat source to the fixing nip section that decreases from upstream to downstream in a direction in which the recording medium is conveyed.

3. The fixing device according to claim 2, wherein a directional cover that concentrates radiant heat of the heat source on the entrance of the fixing nip section is provided on the outer circumference of the heat source.

4. The fixing device according to claim 3, wherein the directional cover provided on the outer circumference of the heat source is opened to the entrance of the fixing nip section.

5. The fixing device according to claim 1, wherein the side surface of each support member is provided with a pinch member proximal to the support member and the belt is sandwiched between the support member and the pinch member.

6. The fixing device according to claim 1, wherein the support members and the heating member are compressed to each other upstream and downstream in a direction in which the recording medium is conveyed, respectively.

7. The fixing device according to claim 1, wherein the heat source is disposed inside the heating member and spaced from the inner circumferential surface of the heating member.

8. The fixing device according to claim 1, wherein one of the support members is a driving roller having a driving means that axially rotates and the other of the support members is a guide roller that has a rotational resistance to provide resistance to circumferential movement of the belt.

9. The fixing device according to claim 1, wherein each support member has a driving mechanism that allows the support member to axially rotate and the linear velocity of the support member downstream in the direction in which the recording medium is conveyed is greater than that of the support member upstream.

10. A fixing device, comprising:

at least two support members;

a belt wound on the support members and supported to be movable in a circumferential direction of the support members;

a heat source heating the belt;

a pressing member compressed to the belt; and a fixing nip section formed between the belt and the pressing member through which a recording medium carrying a toner image passes to heat and fix the toner image onto the recording medium, wherein among suspended portions of the belt suspended between the support members, a first suspended portion is in a tensile state, a second suspended portion is in a non-tensile state, and the pressing member contacts the outside of the tensile suspended portion to form the fixing nip section.

11. The fixing device according to claim 10, wherein a temperature gradient is provided to the fixing nip section by the heat source that decreases from upstream to downstream in a direction in which the recording medium is conveyed.

12. The fixing device according to claim 11, wherein the heat source is disposed inside the belt and spaced from the inner circumferential surface of the belt.

13. The fixing device according to claim 11, wherein a directional cover disposed on the outer circumference of the heat source concentrates radiant heat of the heat source on the entrance of the fixing nip section.

14. The fixing device according to claim 13, wherein the directional cover provided on the outer circumference of the heat source is opened to the entrance of the fixing nip section.

15. The fixing device according to claim 10, wherein the heat source is disposed to heat the support member upstream in a direction in which the recording medium is conveyed among the at least two support members and the belt is heated by means of heat of the heated support member.

16. The fixing device according to claim 10, wherein the at least two support members are disposed in the vicinity of the pressing member with the pressing member therebetween and are disposed upstream and downstream in a direction in which the recording medium is conveyed, respectively.

17. The fixing device according to claim 16, wherein the side surface of each support member is provided with a pinch member proximal to the support member and the belt is sandwiched between the support member and the pinch member.

18. The fixing device according to claim 16, wherein one of the support members is a driving roller that axially rotates by means of a driving mechanism and the other support member is a guide roller that has a rotational resistance to resist circumferential movement of the belt.

19. The fixing device according to claim 16, wherein each support member has a driving mechanism that allows the support member to axially rotate and the linear velocity of the support member downstream in the direction in which the recording medium is conveyed is greater than that of the support member upstream.

20. The fixing device according to claim 10, wherein the support members and the pressing member are compressed to each other upstream and downstream in a direction in which the recording medium is conveyed, respectively.

21. The fixing device according to claim 20, wherein both ends of one suspended portion among the first and second suspended portions of the belt suspended between the support members are sandwiched between the support members and the pressing member in a tensile state.

22. An image forming apparatus, comprising:

a conveying unit that conveys a recording medium in a direction;

at least one image forming unit is provided on the conveying unit to electrostatically transfer a toner image to the recording medium;

a fixing device that fuses and fixes the toner image to the recording medium while conveying the recording medium to which the toner image has been transferred;

wherein the fixing device includes at least two support members;

a belt wound on the support members and supported to be movable in a circumferential direction of the support members;

a heating member compressed to the belt;

a heat source heating the heating member; and a fixing nip section is formed between the belt and the heating member through which the recording medium carrying the toner image passes to heat and fix the toner image onto the recording medium;

wherein among suspended portions of the belt suspended between the support members, a first suspended portion is in a tensile state, a second suspended portion is in a non-tensile state, and the heating member contacts the outside of the tensile suspended portion to form the fixing nip section.

23. The image forming apparatus according to claim 22, wherein a temperature gradient is provided to the fixing nip section by the heat source that decreases from upstream to downstream in a direction in which the recording medium is conveyed.

24. The image forming apparatus according to claim 23, wherein a directional cover that concentrates radiant heat of the heat source on the entrance of the fixing nip section is provided on the outer circumference of the heat source.

25. The image forming apparatus according to claim 24, wherein the directional cover provided on the outer circumference of the heat source is opened to the entrance of the fixing nip section.

26. The image forming apparatus according to claim 22, wherein the side surface of each support member is provided with a pinch member proximal to the support member and the belt is sandwiched between the support member and the pinch member.

27. The image forming apparatus according to claim 22, wherein the support members and the heating member are compressed to each other upstream and downstream in a direction in which the recording medium is conveyed, respectively.

28. The image forming apparatus according to claim 22, wherein the heat source is disposed inside the heating member and spaced from the inner circumferential surface of the heating member.

29. The image forming apparatus according to claim 22, wherein one of the support members is a driving roller having a driving means that axially rotates and the other support member is a guide roller that has a rotational resistance to resist circumferential movement of the belt.

30. An image forming apparatus, comprising:

a conveying unit that conveys a recording medium in a direction;

at least one image forming unit that is provided on the conveying unit to electrostatically transfer a toner image to the recording medium;

a fixing device that fuses and fixes the toner image to the recording medium while conveying the recording medium to which the toner image has been transferred;

wherein the fixing device includes at least two support members;

a belt wound on the support members and supported to be movable in a circumferential direction of the support members;

a heat source heating the belt;

a pressing member compressed to the belt; and a fixing nip section formed between the belt and the pressing member through which the recording medium carrying the toner image passes to heat and fix the toner image onto the recording medium;

wherein among suspended portions of the belt suspended between the support members, a first suspended portion is in a tensile state, a second suspended portion is in a non-tensile state, and the pressing member contacts the outside of the tensile suspended portion to form the fixing nip section.

31. The image forming apparatus according to claim 30, wherein a temperature gradient is provided to the fixing nip section by the heat source that decreases from upstream to downstream in a direction in which the recording medium is conveyed.

32. The image forming apparatus according to claim 31, wherein the heat source is disposed inside the belt and spaced from the inner circumferential surface of the belt.

33. The image forming apparatus according to claim 31, wherein a directional cover that concentrates radiant heat of the heat source on the entrance of the fixing nip section is provided on the outer circumference of the heat source.

34. The image forming apparatus according to claim 33, wherein the directional cover provided on the outer circumference of the heat source is opened to the entrance of the fixing nip section.

35. The image forming apparatus according to claim 30, wherein the heat source is disposed to heat the support member upstream in a direction in which the recording medium is conveyed among the at least two support members and the belt is heated by means of heat of the heated support member.

36. The image forming apparatus according to claim 30, wherein the at least two support members are disposed in the vicinity of the pressing member with the pressing member therebetween and are disposed upstream and downstream in a direction in which the recording medium is conveyed, respectively.

37. The image forming apparatus according to claim 36, wherein the side surface of each support member is provided with a pinch member proximal to the support member and the belt is sandwiched between the support member and the pinch member.

38. The image forming apparatus according to claim 36, wherein one of the support members is a driving roller that axially rotates by means of a driving mechanism and the other of the support members is a guide roller that has a rotational resistance to resist circumferential movement of the belt.

39. The image forming apparatus according to claim 30, wherein the support members and the pressing member are compressed to each other upstream and downstream in a direction in which the recording medium is conveyed, respectively.

40. The image forming apparatus according to claim 30, wherein both ends of one suspended portion among the suspended portions of the belt suspended between the support members are sandwiched between the support members and the pressing member in a tensile state.

* * * * *